US007006779B2

(12) United States Patent
Otani

(10) Patent No.: US 7,006,779 B2
(45) Date of Patent: Feb. 28, 2006

(54) DEVELOPER CARTRIDGE, IMAGE FORMING UNIT, AND IMAGE FORMING APPARATUS

(75) Inventor: Shinichi Otani, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 10/873,488

(22) Filed: Jun. 23, 2004

(65) Prior Publication Data

US 2004/0265010 A1 Dec. 30, 2004

(30) Foreign Application Priority Data

Jun. 24, 2003 (JP) ..... 2003-179529

(51) Int. Cl.
*G03G 15/08* (2006.01)

(52) U.S. Cl. ..... 399/258; 399/260; 399/262

(58) Field of Classification Search ..... 399/258–262, 399/111

See application file for complete search history.

(56) References Cited

U.S. PATENT DOCUMENTS

| | | | | |
|---|---|---|---|---|
| 6,418,292 | B1 * | 7/2002 | Isobe et al. | 399/258 |
| 6,438,345 | B1 * | 8/2002 | Ban et al. | 399/262 |
| 2001/0001025 | A1 * | 5/2001 | Nakajima | 399/120 |

* cited by examiner

*Primary Examiner*—William J. Royer
(74) *Attorney, Agent, or Firm*—Takeuchi & Kubotera, LLP

(57) ABSTRACT

A cleaning member (16) for cleaning an open/close mechanism (14) for opening/closing a supply port (1*a*) of a toner cartridge (1) is moved in sync with operation of the open/close mechanism. The cleaning member (16) is in contact with the open/close mechanism (14) for scraping the toner from the outside surface of the open/close mechanism (14), thus preventing the toner from dirtying the unit, etc. when the toner cartridge (1) is removed.

21 Claims, 16 Drawing Sheets

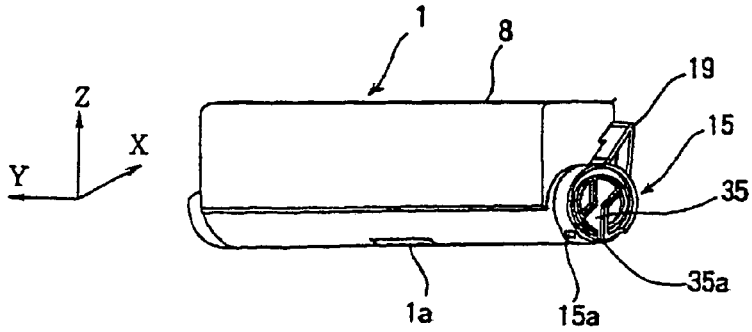
FIG. 2(a)
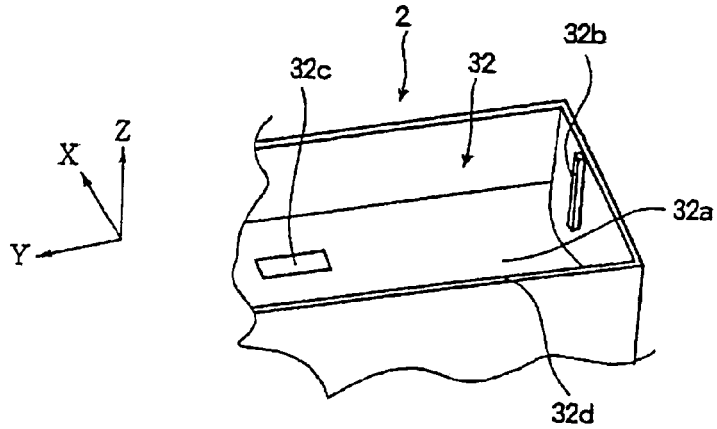
FIG. 2(b)
FIG. 3
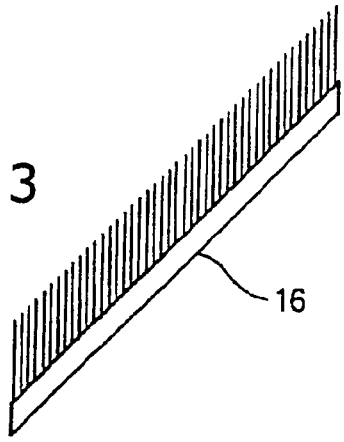

FIG. 12(a)
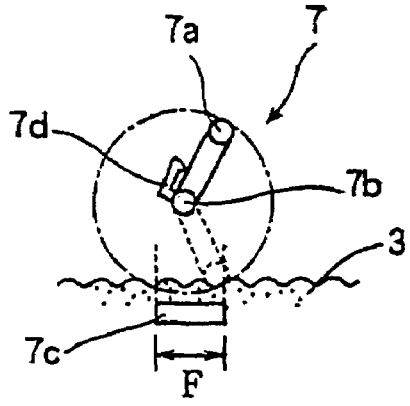
FIG. 12(b)
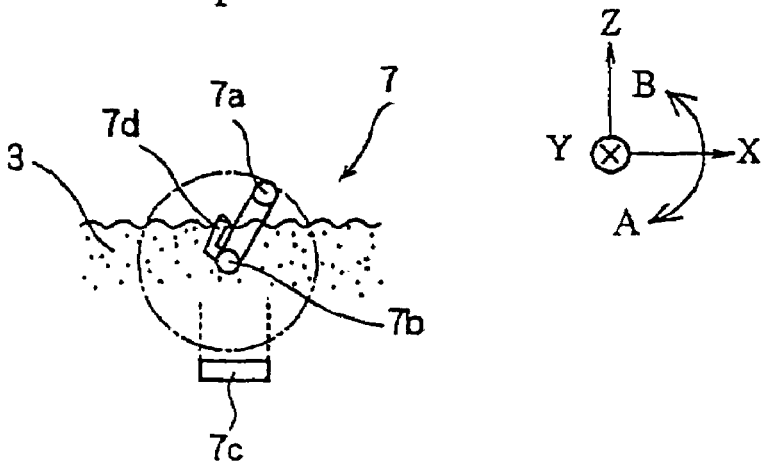
FIG. 12(c)
FIG. 12(d)
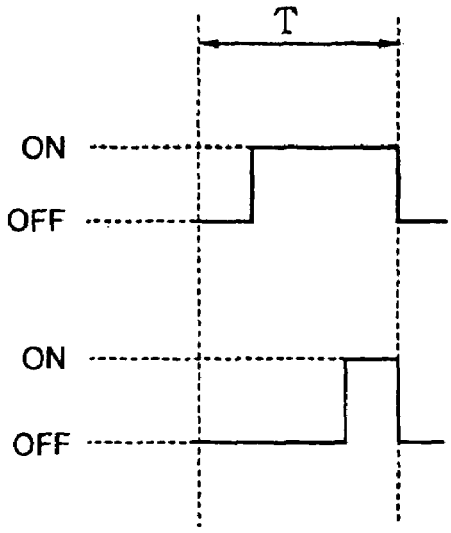

DEVELOPER CARTRIDGE, IMAGE FORMING UNIT, AND IMAGE FORMING APPARATUS

BACKGROUND OF THE INVENTION

1. Field of the Invention

The present invention relates to an image forming unit mountable in an image forming apparatus and a toner cartridge detachable from the image forming unit.

2. Description of the Related Art

A developer cartridge (hereinafter "toner cartridge") is detachably mounted in an image forming unit (hereinafter "process cartridge") that is mounted in an image forming apparatus. The toner cartridge has an opening for supplying a toner to the process cartridge and a valve member for opening/closing the opening. It is detached from the process cartridge after the opening is closed by the valve member to prevent the toner from falling from the opening. However, the toner adhering to the outside of the opening can fall to make the interior of the apparatus or the hand or clothing of the operator dirty. Consequently, the replacement of a toner cartridge has been troublesome for the operator.

SUMMARY OF THE INVENTION

Accordingly, it is an object of the invention to provide a toner cartridge capable of preventing the toner from falling from the cartridge to make the hand or clothing of the operator dirty and facilitating the cartridge replacement.

It is another object of the invention to provide a toner cartridge having a toner amount detector to control the toner supply, thus preventing the toner from blocking the movement of the shutter for scraping the toner that adheres to the toner cartridge.

It is still another object of the invention to provide a toner cartridge having a driving mechanism that drives a cleaning member for a few times based on the operator's action to scrape the toner from the cartridge without failure.

It is yet another object of the invention to provide a toner cartridge having a common mechanism for a cleaning member and a toner shutter to control the toner supply and scrape the toner from the toner cartridge.

It is another object of the invention to provide a toner cartridge capable of scraping the toner adhering to the cartridge in linkage with the operative section provided in the process cartridge.

BRIEF DESCRIPTION OF THE DRAWINGS

FIG. 2(*a*) is a perspective view of the toner cartridge;

FIG. 2(*b*) is a perspective view of a cartridge mounting section of the process cartridge;

FIG. 3 is a perspective view of a cleaning member or linear brush according to the first embodiment;

FIG. 4(*b*) is a side view of the cleaning mechanism;

FIGS. 12(*a*) and 12(*b*) are side views of the toner amount detector;

FIGS. 12(*c*) and 12(*d*) are graphs showing the output of the toner amount detector;

DESCRIPTION OF THE PREFERRED EMBODIMENTS

Figure 1:
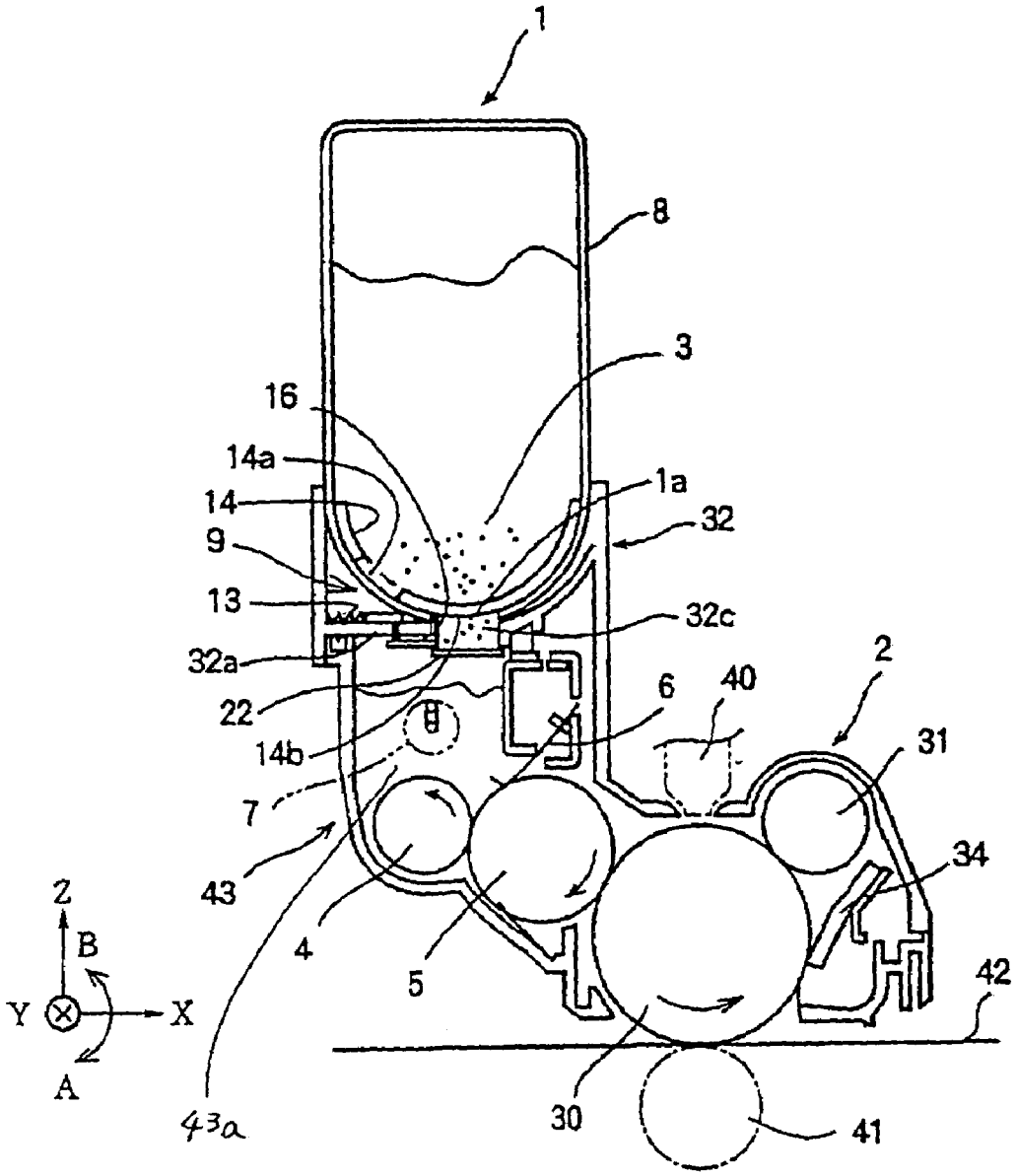
FIG. 1 is a sectional view of a toner cartridge and a process cartridge according to the first embodiment of the invention.

Embodiments of the invention will now be described with reference to the accompanying drawings, wherein the same components are given the same reference characters.

First Embodiment

In FIG. 1, a toner cartridge 1 contains toner 3 and has a toner case 8 with a toner supplying port 1*a* and an inner shutter 14 rotatable within the toner case 8. The inner shutter 14 has a variable opening 14*a* for supplying the toner 3 when it overlaps the toner opening 1*a*. A process cartridge 2 has a photosensitive drum 30, a charging roller 31, a developing section 43, a cleaning blade 34, and a mounting section 32 for receiving the toner cartridge 1. The photosensitive drum 30 is rotatable about an axis, and an electrostatic latent image is formed on its circumferential surface. The charging roller 31 is in contact with the photosensitive roller 30 to uniformly charge the circumferential surface of the photosensitive roller 30. An exposing device 40, which is attached to an image forming unit and composed of LED heads, illuminates the charged photosensitive drum 30 to form the latent image according to the printing image.

The developing section 43 has a developing roller 5 for supplying toner to the latent image on the photosensitive drum 30, a toner supplying roller 4 for supplying the toner to the developing roller, a developing blade 6 for forming a uniform thin film of toner on the developing roller 5, a toner compartment 43 for accommodating the toner supplied from the toner cartridge 1, and a toner detector provided within the toner compartment. The toner is charged by frictional electrification of the developing roller 5 and the toner supply roller 4. The charged toner adheres to the latent image on the photosensitive drum 30 to form a visible image within the developing section 43.

A transfer roller 41 is provided in the image forming unit and transfers the visible image from the photosensitive drum 30 to a recording medium 42 transported by a transporting unit (not shown). The visible image is fixed to the recording medium by heat and pressure from a fixing unit (not shown). The cleaning blade 34 removes the toner remaining on the photosensitive drum 30. The process cartridge 2 has a control shutter 22 for controlling the amount of toner from the toner cartridge 1 through the toner opening 1*a*, a cleaning member 16 for cleaning the outside 14*b* of the inner shutter 14, and a cleaning mechanism 9 for moving the cleaning member 16.

A predetermined high voltage is applied to the charging roller 31, the developing roller 5, the supply roller 4, and the transfer roller 41 for the image forming process. In this embodiment, a reversal developing system is employed so that a negative high voltage is applied to the charging roller 31, the developing roller 5, and the supply roller 4 and a positive high voltage is applied to the transfer roller 41. It is understood that the invention is also applicable to the regular developing system. Throughout the drawings, the Y axis extends parallel to the axis of the photosensitive drum 30, the X axis extends parallel to the direction in which the recording medium is transported, and the Z axis intersects these axes at right angles. The photosensitive drum 30 rotates in the direction of arrow B about the Y axis. Consequently, the recording medium 42 is transported in the positive direction of the X axis.

In FIGS. 2(*a*) and 2(*b*), the toner case 8 of the toner cartridge 1 has a cylindrical bottom having a toner opening 1*a* at its center. Alternatively, a plurality of toner openings may be provided. The inner shutter 14 is made cylindrical and rotatable inside and along the cylindrical bottom of the toner case 8. The inner shutter 14 is fixed to a rotary member 15 provided outside of the toner case 8 so that it is rotated by the rotary member 15. An operation lever 19 is provided on the circumferential surface of the rotary member 15 such that the operator operates the lever 19 to rotate the rotary member 15, thereby rotating the inner shutter 14. The inner shutter 14 has the variable opening 14*a* at a position opposed to the toner opening 1*a*. The variable opening 14*a* overlaps the toner opening 1*a* at a predetermined angle of the rotary member 15 to allow the toner 3 to enter the process cartridge 2. The inner shutter 14, the rotary member 15, and the operation lever 19 constitute an open/close mechanism for opening/closing the toner opening.

The process cartridge 2 has a mounting section 32 for mounting the toner cartridge 1. A toner inlet 32*c* to the toner compartment 43*a* is provided in the mounting bottom 32*a* of the process cartridge 2 at a position opposed to the toner opening 1*a* of the toner cartridge 1. The toner 3 in the toner cartridge 1 is supplied to the toner compartment 43*a* through the variable opening 14*a*, the toner opening 1*a*, and the toner inlet 32*c*.

An X-shaped groove 35 is provided in the end surface of the rotary member 15. A cutout 35*a* is provided in the X-shaped groove on the side of the process cartridge 2. An outside frame wall 32*d* of the mounting section 32 has a guide ridge 32*b* extending along the Z axis. To install the toner cartridge 1 in the mounting section 32 of the process cartridge 2, the cutout 35*a* of the X-shaped groove 35 is guided to the guide ridge 32*b* such that the guide ridge 32*b* fits in the X-shaped groove 35. When the rotary member 15 is rotated by the operation lever 19, the guide ridge 32*b* abuts against the side wall of the X-shaped groove to control the rotation amount within a predetermined range. An engaging projection 15*a* is provided on the circumferential surface of the rotary member 15 for engagement with the later described cleaning mechanism 9 which is provided on the mounting bottom 32*a* of the process cartridge 2.

In FIG. 3, a cleaning member 16 is made up of cotton brush preferably made of a springy material.

Figure 4A:
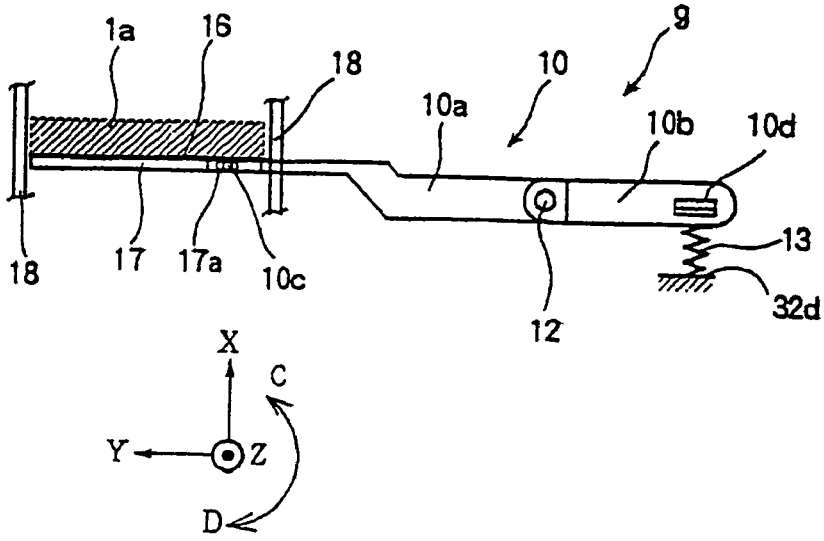
FIG. 4(*a*) is a plan view of a cleaning mechanism according to the first embodiment.
Figure 4B:
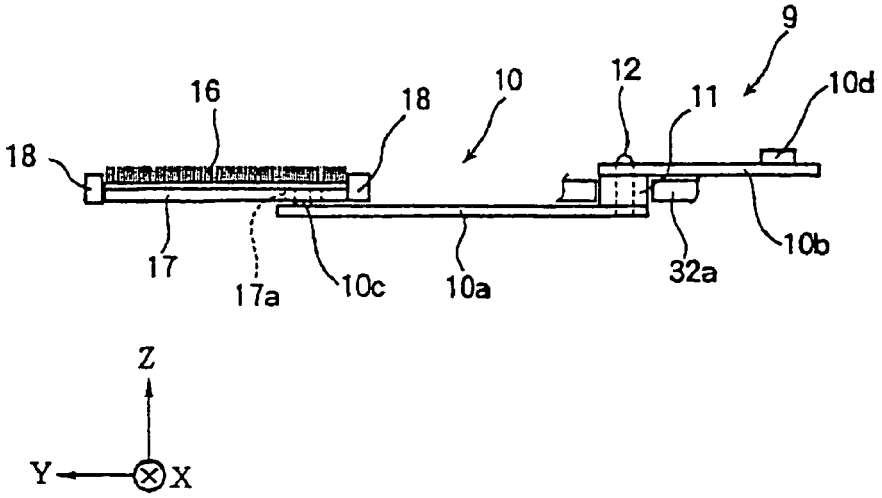
Figure 5:
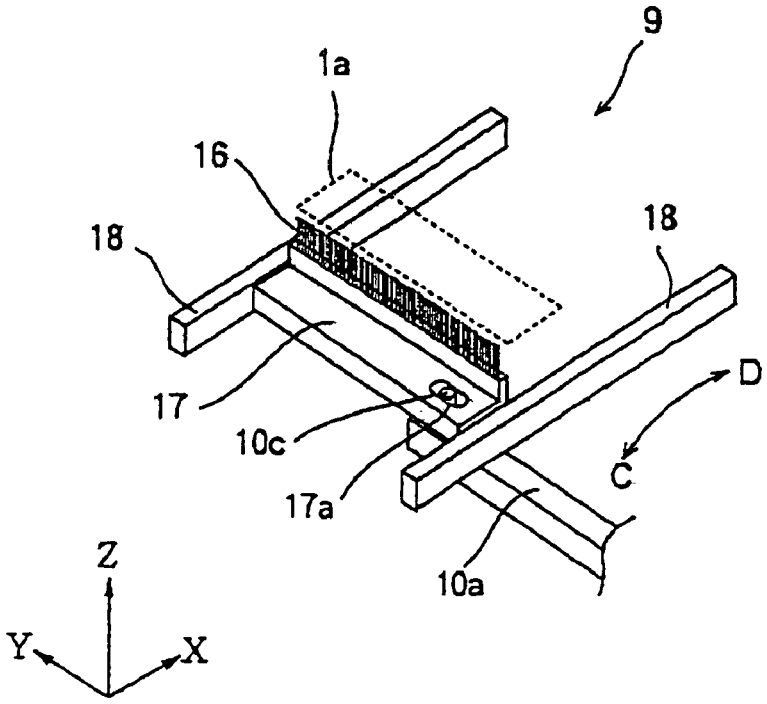
FIG. 5 is a perspective view of a front portion of the cleaning mechanism.

In FIGS. 4(*a*) and 4(*b*), a link lever 10 of the cleaning mechanism 9 includes an upper lever 10*b* and a lower lever 10*a* connected by a fixing rod 12 within a column 11 that is rotatably supported by the mounting bottom 32*a*. An engaging pin 10*c* is provided at the other end of the lever 10*a* for engagement with an elongated hole 17*a* of a cleaning plate 17 with the cleaning member 16. A pair of guides 18 is provided on the mounting section 32 at a predetermined position to engage the cleaning plate 17 with the lever 10*a* for sliding movement along the X axis. As the cleaning plate 17 slides, the brush of the cleaning member 16 slightly enters the toner opening 1*a* and moves the entire area of the toner opening 1*a* as shown by dotted line in FIG. 5.

An engaging pin 10*c* provided at the front end of the lever 10*a* movably fits in an elongated hole 17*a* provided at the end portion of the cleaning plate 17. Consequently, the rotation of the link lever 10 in the direction of arrow C or D moves the cleaning plate 17 along the X axis in the negative or positive direction. The link lever 10 and the cleaning plate 17 constitute a moving device. The link lever 10 is biased in the direction of arrow C by a coil spring 13 provided between the front end of the lever 10*b* and the frame wall 32*d* of the mounting section 32. An engaging projection 10*d* is provided on the end portion of the lever 10*b* opposite to the fixing axis. The link lever 10 engages with the engaging projection 15*a* (FIG. 2) provided on the circumferential surface of the rotary member 15 for rotation as later described.

Figure 6:
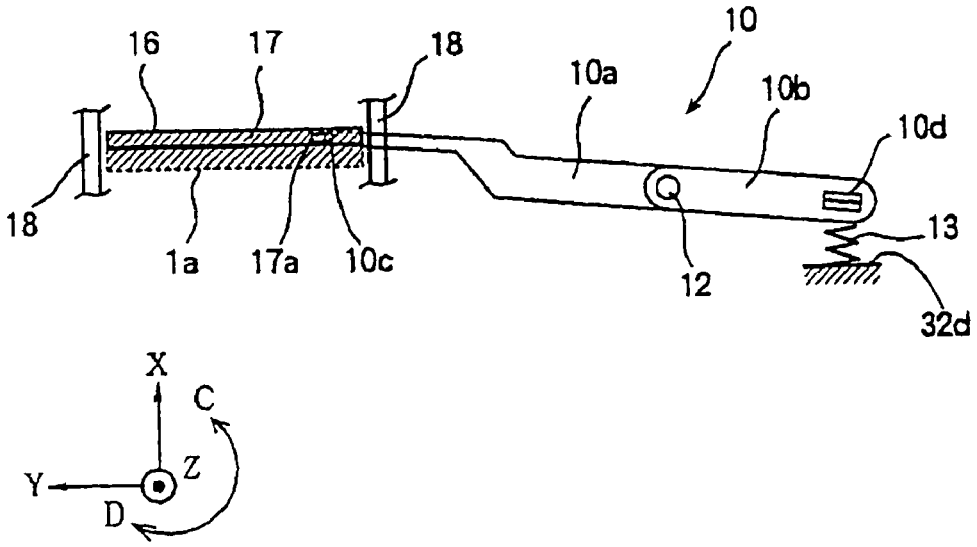
FIG. 6 is a plan view of the cleaning member in action.

FIG. 4(*a*) shows the stand-by position wherein the cleaning member 16 is located at the end of the toner opening 1*a* in the negative direction of the X axis. FIG. 6 shows the moved position wherein the link lever 10 is rotated in the direction of arrow D, bringing the cleaning member 16 to the end of the toner opening 1*a* on the positive side of the X axis.

The operation of the toner cartridge 1 and the process cartridge 2, more specifically the inner shutter 14 and the rotary member 15, will be described in more detail with reference to FIGS. 7 and 8.

When the toner cartridge 1 with the open/close mechanism for supplying the toner 3 is removed from the process cartridge 2 or the supply of toner 3 from the toner cartridge 1 to the process cartridge 2 is stopped, the inner shutter 14 is rotated to such a position that the variable opening 14*a* does not overlap the toner opening 1*a* of the toner cartridge 1, thus closing the toner opening 1*a* with the inner shutter 14.

Figure 7:
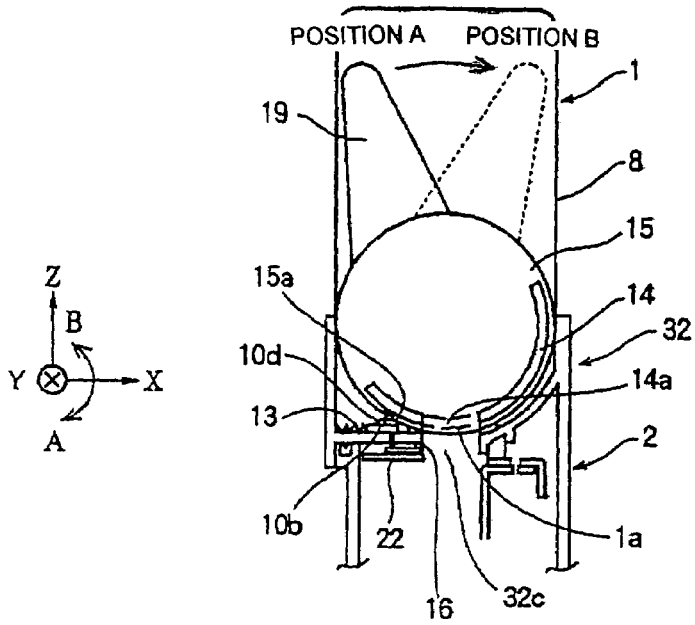
FIG. 7 is a side view of the toner cartridge wherein the cleaning mechanism is at the stand-by position.
Figure 8:
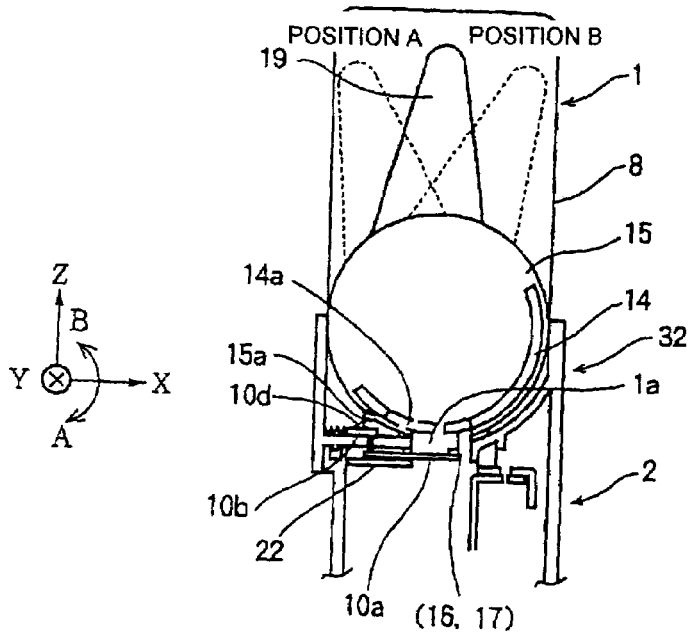
FIG. 8 is a side view of the toner cartridge wherein the cleaning mechanism is at a cleaning position between the stand-by and end positions.

In FIG. 7, when the operation lever 19 is at the position A, the variable opening 14*a* of the inner shutter 14 overlaps the toner opening 1*a* of the toner cartridge 1. In this sate, the toner 3 in the toner cartridge 1 is supplied to the process cartridge 2. At this point, the engaging projection 15*a* on the rotary member 15 engages with the engaging projection 10*a* of the link lever 10. The cleaning plate 17, however, is at the stand-by position by the coil spring 13 as shown in FIG. 4(*a*). That is, unless the operation lever 19 is rotated, the cleaning plate 17 remains at the stand-by position.

When the operation lever 19 is rotated toward the position B, the rotary member 15 is rotated in the direction of arrow A. FIG. 8 shows the operation lever at a middle point between the positions A and B. The rotation of the operation lever 19 rotates the rotary member 15, bringing the inner shutter 14 to the position where the toner opening 1*a* is half closed. When the operation lever 19 is further moved toward the position B, the engaging projection 15*a* of the rotary member 15 pushes the engaging projection 10*d* of the link lever 10, rotating the link lever 10 against the coil spring 13 in the direction of arrow D from the state of FIG. 4(*a*). As the link lever 10 rotates, the cleaning plate 17 moves along the X axis in the positive direction, with the cleaning member 16 guided by the guide 18 to the position shown in FIG. 8. The front end of brush of the cleaning member 16 is brought into contact with the outer surface 14*b* of the inner shutter 14, thereby scraping the toner adhering to the outer surface 14*b*.

Figure 9:
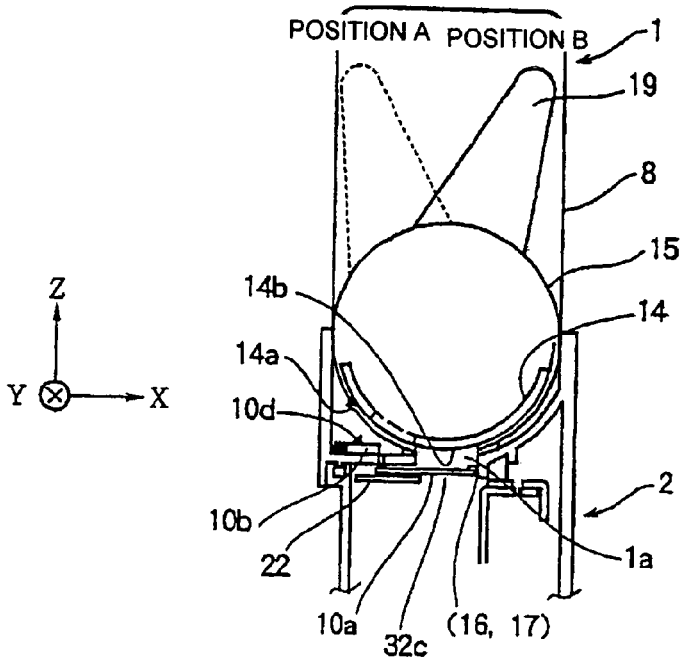
FIG. 9 is a side view of the toner cartridge wherein the cleaning mechanism is at the end position.

When the operation lever 19 is moved to the position B, the rotary member 15 is further rotated in the direction of arrow A to the position shown in FIG. 9, wherein the toner opening 1*a* is closed completely by the inner shutter 14 so that the toner 3 in the toner cartridge 1 is not supplied (toner supply shut-off state). The engaging projection 15*a* of the rotary member 15 further moves the engaging projection 10*d* of the link lever 10 against the coil spring 13 in the direction of arrow D (FIG. 6), bringing the cleaning member 16 to the moved position of FIG. 6 or the end of the toner opening 1*a* on the positive side of the X axis.

When the operation lever 19 reaches the position B, the engagement between the engaging projections 15*a* and 10*d* is released so that the link lever 10 is rotated by the coil spring 13 in the direction of arrow C in FIG. 6. Consequently, the cleaning plate 17 returns to the stand-by position in FIG. 4(*a*) or FIG. 7. Thus, the cleaning member 16 cleans the outer surface 14*b* of the inner shutter 14, with the toner opening 1*a* is shut completely. FIG. 9 shows the condition immediately before the engagement between the engaging projections 15*a* and 10*d* is released, bringing the cleaning plate 17 and the cleaning member 16 to the stand-by position of FIG. 7.

As described above, when the operation lever 19 is moved from the position A to the position B, the toner cartridge 1 is changed from the toner supply state to the toner shut-off state and the cleaning member 16 cleans the outer surface 14*b* of the inner shutter 14 that closes the toner opening 1*a*. Then, the coil spring 13 moves the cleaning member 16 in the reverse direction to clean the outer surface 14*b*. Thus, the cleaning member 16 makes a round trip to clean the outer surface 14*b*, removing the adhering toner.

To change the toner cartridge 1 from the toner shut-off state to the toner supply state, the operation lever 19 is moved from the position B to the position A. At this point, the link lever 10 is at the stand-by position so that the engaging projection 10*d* is at the position of FIG. 7 so that the engaging projection 15*a* moves from the position of FIG. 9 to the position of FIG. 7. The engaging projection 15*a* is so flexible to be deformed by the engaging projection 10*d* so that its movement is not blocked by the engaging projection 10*d*. The cleaning member 16 has such a shape that it maintains the engagement with the engaging projection 10*d* and stays at the stand-by position when the engaging projection 15*a* passes over the engaging projection 10*d* by deformation.

The contact pressure between the cleaning member 16 and the outer surface 14*b* of the inner shutter 14 (FIG. 9) is set at such a level that it puts no excessive load on the movement of the cleaning plate 17 but secures the toner removal. The toner inlet 32*c* in the mounting section 32 (FIG. 2(*b*)) communicates with the interior of the process cartridge 2 via a predetermined hollow section. An open/close shutter 22 is provided within the process cartridge 2 for opening/closing the driving section.

Figure 10:
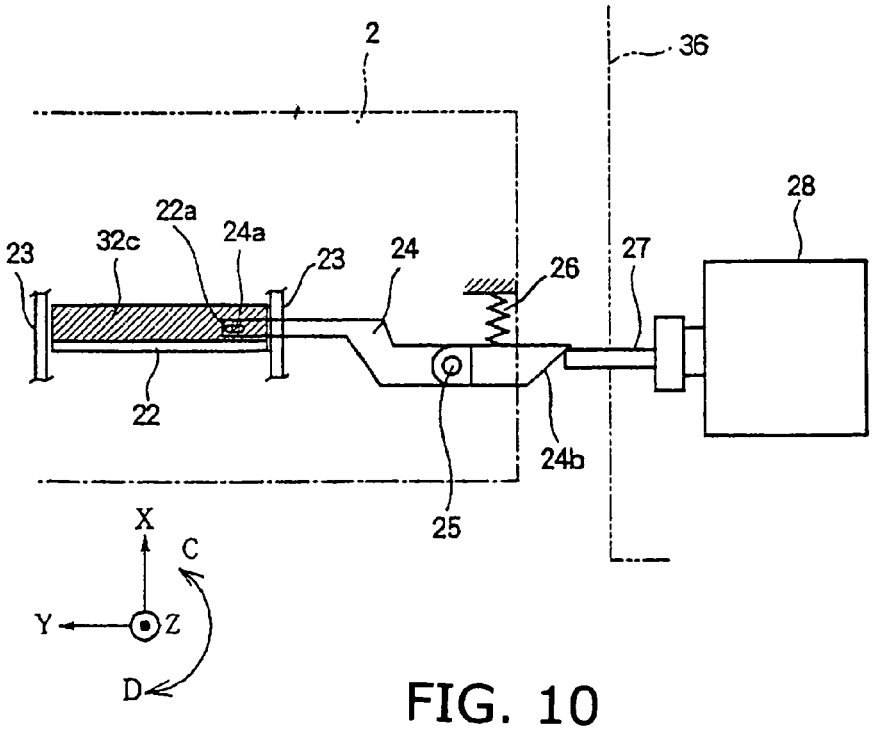
FIG. 10 is a plan view of an essential part of the open/close mechanism.

In FIG. 10, the open/close shutter 22 of an open/close mechanism is slid along the X axis by the guide 23 provided within the process cartridge 2 between the close position to close the toner inlet 32*c* and the open position to open the toner inlet 32*c*. The guide 23 is provided at a predetermined position on the mounting bottom 32 of the process cartridge 2. An elongated hole 22*a* is provided in the open/close shutter 22 and movably receives an engaging pin 24*a* provided on an end of the open/close lever 24 supported for rotation about the Z axis by a pivot 25 that is provided at a predetermined position within the process cartridge 2. The open/close lever 24 has a slant edge 24*b* and biased by a coil spring 26 in the direction of arrow D. This bias normally keeps the open/close shutter 22 at the close position to close the toner inlet 32 as shown in FIG. 10. The slant edge 24*b* engages with a driving device or the operation lever 27 of a solenoid 28 attached to the body of the image forming unit 36.

The solenoid 28 is controlled by a later described control section and turned on to project the operation lever 27 in the positive direction of the Y axis for a predetermined time. This rotates the open/close lever 24 by a predetermined angle in the direction of arrow C which, in turn, moves the open/close shutter 22 along the guide 23 in the negative direction of the X axis to the open position to open the toner inlet 32*c*. As described above, only when the solenoid 28 is on, the open/close mechanism opens the toner inlet 32*c*.

Figure 11:
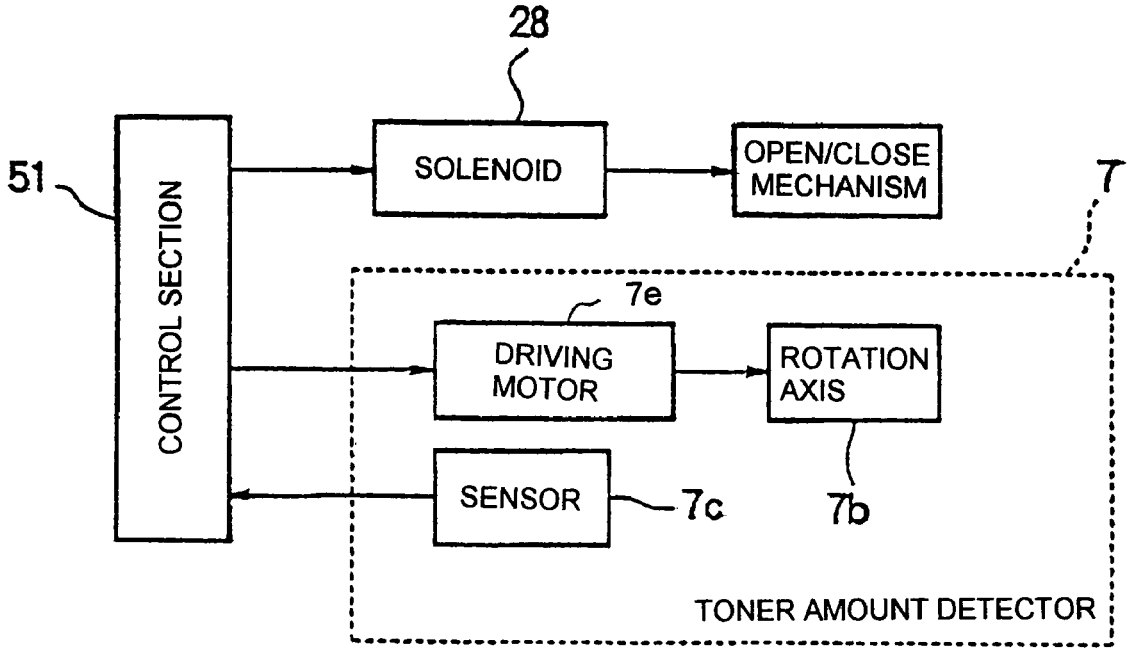
FIG. 11 is a block diagram of a control system for a toner amount detector and the open/close mechanism according to the first embodiment.

In FIG. 11, a printing control section 51 controls the entire image forming unit. Especially, in this embodiment, it operates the open/close mechanism and a toner amount detector 7. It instructs the solenoid 28 to operate the open/close mechanism. The toner amount detector 7 has a driving motor 7*e* for rotating a regulating member 7*d* at a constant speed in response to an instruction from the control section 51 and a sensor 7*c* for detecting the operation of a stirring member 7*a*.

In FIGS. 12(*a*) and 12(*b*), the toner amount detector 7 also has a toner stirring function, and the stirring member 7*a* is attached to a rotation shaft 7*b*, which is rotatable in the direction of arrow A. The stirring member 7*a* extends in the longitudinal direction of the process cartridge 2 and stirs the toner inside the process cartridge 2. The stirring member 7*a* is rotatable about the rotation shaft 7*b*, and its rotation is regulated within a certain range by the regulating member 7*d* that is fixed to the rotation shaft 7*b*. The regulating member 7*d* continues to rotate at a constant speed, and the stirring member 7*a* is rotated by the regulating member 7*d* up to the highest point. When the stirring member 7*a* reaches the highest point, it rotates itself by gravity in the direction of arrow A and stops at a position that depends on the amount of toner. If the stop position falls within the detection range of the sensor 7*c*, the time it remains in the range of the sensor 7*c* becomes long, make it possible to detect the remaining amount of toner.

The sensor 7*c* sends an "on" signal to the control section when the front end of the stirring member 7*a* reaches the detection area F. As shown in FIG. 12(*a*), where only a small amount of toner 3 remains at the bottom portion of the rotation area of the stirring member 7*a*, when the front end of the stirring member 7*a* passes the highest position, it rotates by its own weight into the remaining toner, reaching the detection area F to be detected by the sensor 7*c*. Then, when the regulating member 7*d*, which rotates at the predetermined speed, abuts again against the stirring member 7*a*, the stirring member 7*a* starts to rotate in the same direction along with the rotation shaft 7*b*, stirring the toner and passing the detection range F toward the highest point.

As shown in FIG. 12(*b*), where the toner fills space around the stirring member 7*a*, the regulating member 7*d* of the rotation shaft 7*b* pushes and rotates the stirring member 7*a* in the direction of arrow A in the entire rotation range at the predetermined speed, stirring the toner. Thus, if the amount of remaining toner is small as shown in FIG. 12(*a*), the output waveform of the sensor 7*c* becomes as shown in FIG. 12(*c*). If the amount of remaining tone is large as shown in FIG. 12(*b*), the output waveform of the sensor 7*c* looks like FIG. 12(*d*). The ratio of the "on" state to the detection period T for the small amount of remaining toner is larger than that of the large amount of remaining toner.

As described above, the toner amount detector 7 not only stirs the toner 3 but also sends out a detection signal that the ratio of the "on" state to the detection period T in the toner low state is larger than that of the toner full state.

Figure 13:
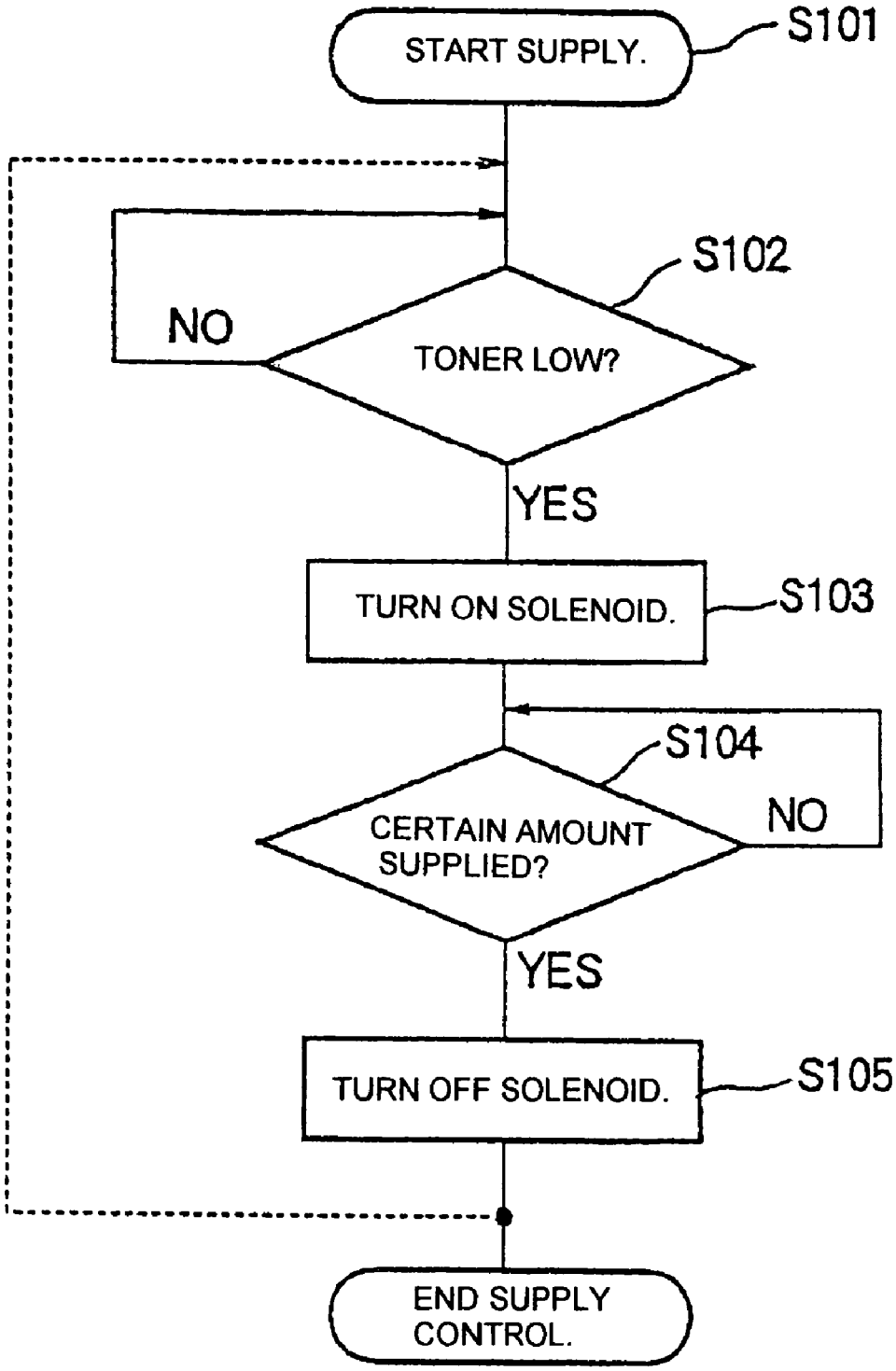
FIG. 13 is a flow chart for controlling a toner supply.

The operation of the control system will be described with reference to FIG. 13.

In Step S101, the toner supplying operation is started by the control section 51. The toner supply starting operation is made when the control section 51 is notified of printing start, during printing, after power-on, or upon return from the stand-by state.

In Step S102, the control section 51 monitors the detection signal from the sensor 7*c* to determine, based on the ratio of the "on" state to the detection period T, if there is a toner-low state that the toner in the process cartridge is below a predetermined amount.

In Step S103, if the toner low state is detected, the control section 51 turns on the solenoid 28 to open the toner inlet 32*c* for starting to supply the toner 3 to the process cartridge 2 from the toner cartridge 1.

In Step S104, the toner amount detector 7 checks if the supply reaches the predetermined amount. Alternatively, the relationship between the time period in which the open/close shutter 22 is opened and the amount of toner supply has bee determined, and a predetermined time period is set for effecting the supply.

In Step S105, when the amount of toner supply reaches the predetermined level, the control section 51 turns off the solenoid 28 to close the toner inlet 32*c*, terminating the toner supply. Where the toner supply always is made, the process is returned to Step S102 to repeat the above operation.

Alternatively, the cotton brush 16 may be replaced with an appropriate shape of polyester film, rubber blade, or sponge.

As has been described above, according to the invention, the toner adhering to the outer surface 14*b* of the inner shutter 14 is scraped off in sync with the rotation of the inner shutter 14 when the toner opening 1*a* is closed so that when the toner cartridge 1 is replaced, it is prevented to fall the toner within or outside the printing unit or to make the hand or cloth of the operator dirty. The outer surface 14*b* is cleaned twice when the toner opening 1*a* is being closed and after it has been closed, thus assuring the toner scraping.

The cleaning plate 17 is moved in sync with the rotation of the link lever 10 so that the engagement between the engaging projections 15*a* and 10*d* is maintained to provide a predetermined moving distance of the cleaning plate 17. The moving range of the cleaning member 16 is made within the area of the toner inlet 32*c* of the process cartridge 2 so that the fall of the toner 3 is housed in the process cartridge 2. The amount of toner supply from the toner cartridge 1 to the process cartridge 2 is limited so that there is a space in the upper portion of the process cartridge, thus preventing the toner 3 from blocking the operation of the shutter 22.

The cleaning plate 17 is moved in sync with the rotation of the link lever 10 so that the engagement between the engaging projections 15*a* and 10*d* is maintained to provide a predetermined moving distance of the cleaning plate 17. The moving range of the cleaning member 16 is made within the area of the toner inlet 32*c* of the process cartridge 2 so that the fall of the toner 3 is housed in the process cartridge 2. The amount of toner supply from the toner cartridge 1 to the process cartridge 2 so that there is a space in the upper portion of the process cartridge, thus preventing the toner 3 from blocking the operation of the shutter 22.

Second Embodiment

Figure 14A:
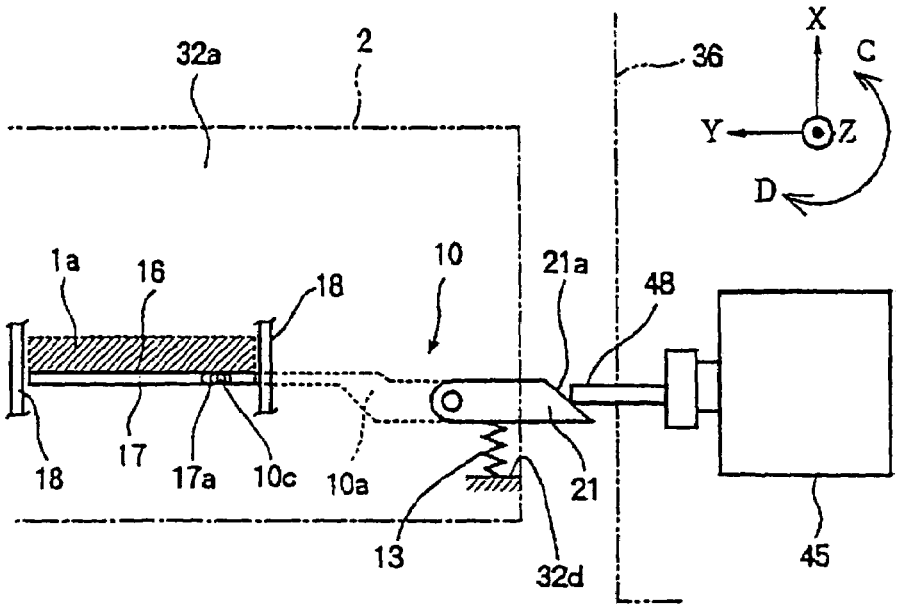
FIGS. 14(*a*) and 14(*b*) are plan views of the essential part of an open/close mechanism according to the second embodiment of the invention.
Figure 14B:
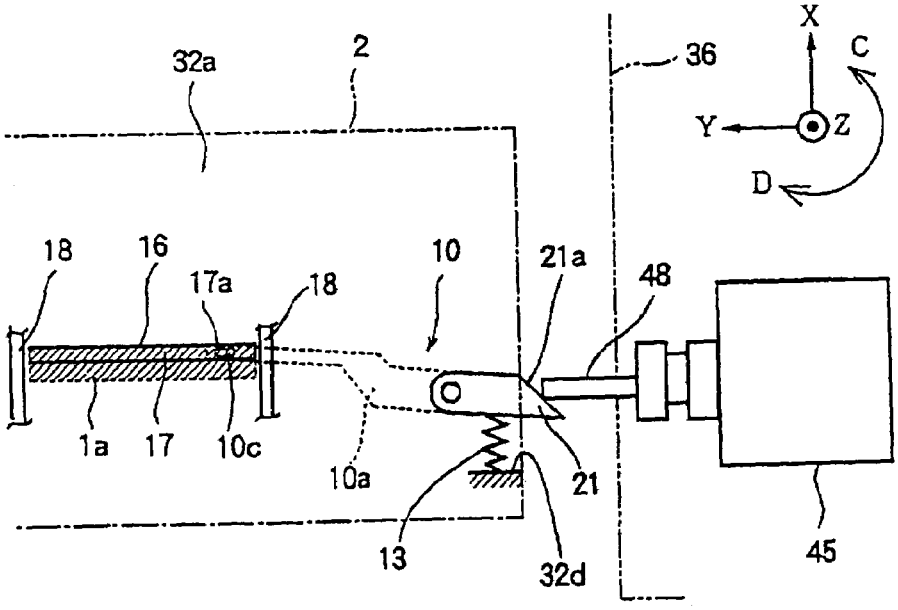

In FIGS. 14(*a*) and 14(*b*), the image forming unit of this embodiment is different from that of the first embodiment in that the cleaning plate is moved by an electrical mechanism including a solenoid. A link lever 10 is provided on the mounting bottom 32*a* of the process cartridge 2 for sliding the cleaning plate 17 with an elongated hole 17*a*. A slant engaging edge 21*a* is provided at an end of the link lever 10 instead of the link lever 10*b* with the engaging projection 10*d* (FIG. 4). The engaging edge 21*a* engages with the operation lever 48 of a solenoid 45 attached to the body of an image forming unit 36.

In response to the operation "on", the solenoid 45 projects the operation lever 48 by a predetermined distance in the positive direction of the Y axis to rotate the open/close lever 21 by a predetermined angle in the direction of arrow D. This moves the cleaning plate 17 along the guide 18 from the stand-by position of FIG. 14(*a*) to the moved position of FIG. 14(*b*). That is, the cleaning plate 17 moves to the moved position only when the solenoid 45 is turned on.

Figure 15:
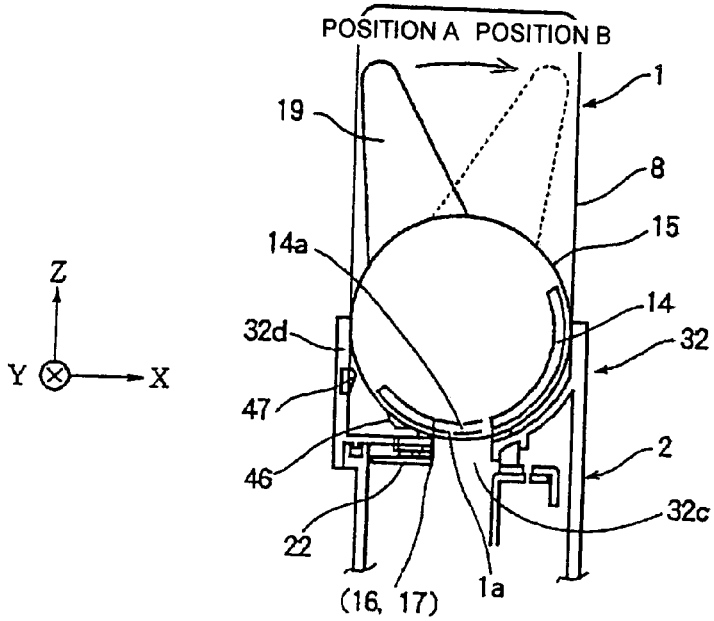
FIG. 15 is a side view of the toner cartridge at the toner supply position.

In FIG. 15, a noticing member or detection projection 46 is provided on the circumferential surface of the rotary member 15 in stead of the engaging projection 15*a* of the first embodiment. A detection device or switch 47 is provided on the inside of a frame wall 32*d* for the process cartridge 2 for detecting the contact with the detection projection 46. The operation lever 19 is at the position A so that the toner opening 1*a* overlaps the variable opening 14*a* of the inner shutter 14 to supply the toner (toner supply state).

Figure 16:
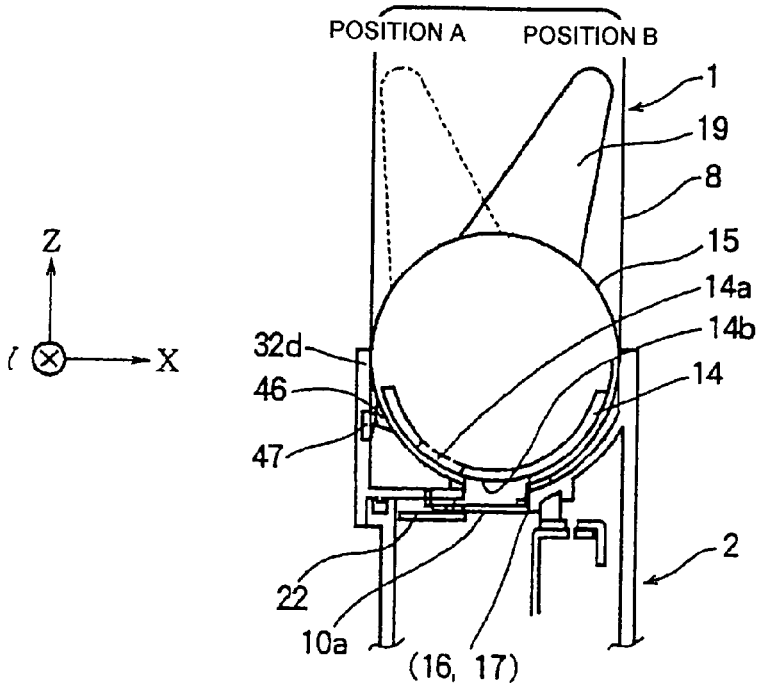
FIG. 16 is a side view of the toner cartridge at the closed position.

In FIG. 16, when the operation lever 19 is rotated to the position B to close the toner opening 1*a* with the inner shutter 14, the detection projection 46 presses the detection switch 47 into the "on" state. That is, the detection switch 47 is turned on when the toner cartridge 1 is closed and, otherwise, off and sends a detection signal to the control section.

Figure 17:
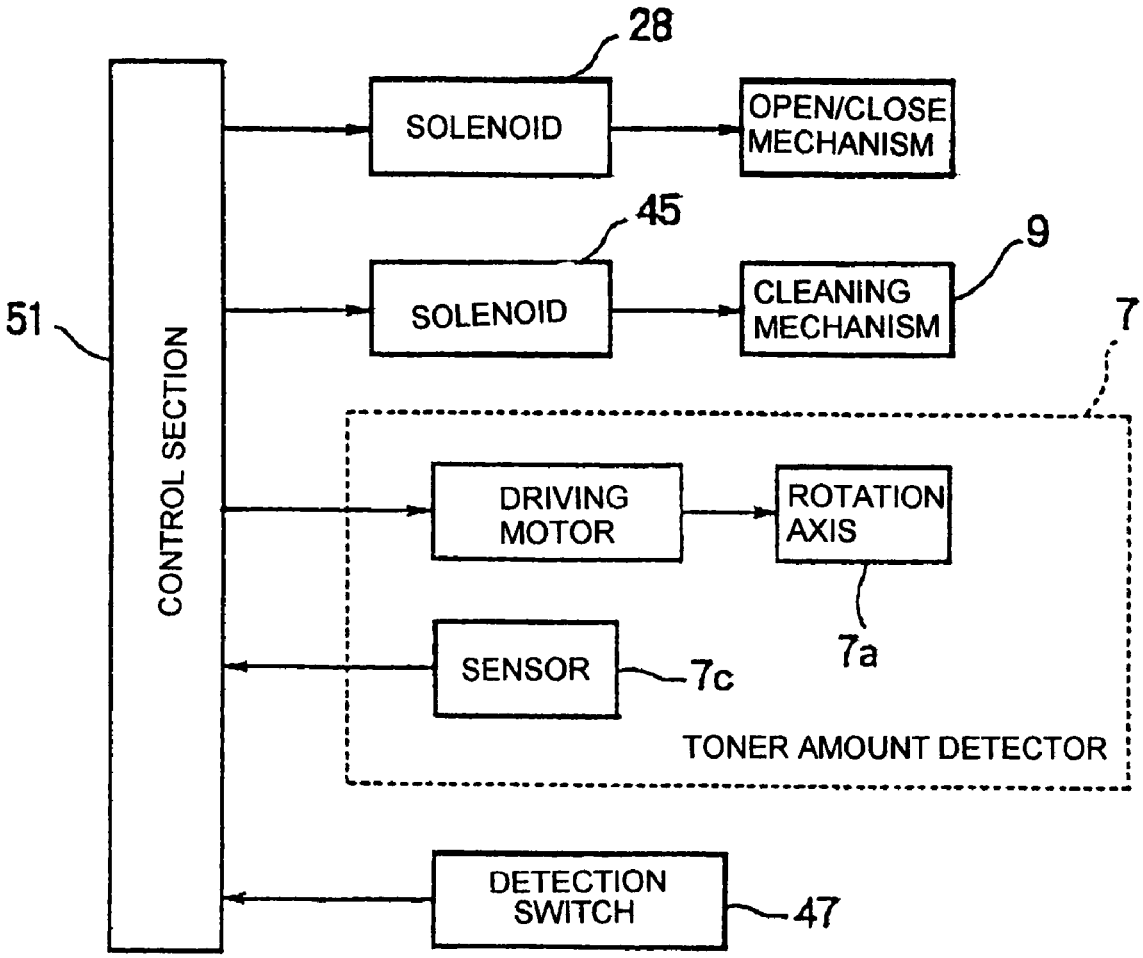
FIG. 17 is a block diagram of a controlling system for driving the cleaning mechanism according to the second embodiment.

In FIG. 17, the control system controls the operation of the cleaning mechanism in response to the detection signal from the detection switch 47. The open/close operation of the toner inlet 32*c* is the same as that of the first embodiment and, therefore, its description will be omitted. When the operation lever 19 is turned from the toner supply state at the position A to the toner shut-off state at the position B, the detection switch 47 is turned on. The control section 51 detects it to recognize that the toner cartridge 1 is in the toner shut-off state, bringing the solenoid 45 into the "on" state for a predetermined period. In sync with the "on/off" control of the solenoid 45, the cleaning member 16 makes a round trip to scrap the toner from the outer surface 14*b* of the inner shutter 14. Alternatively, the solenoid 45 may be turned on/off for a few times so that the cleaning member 16 makes round trips for a few times.

As has been described above, according to the second embodiment, it is possible to set freely the number of cleaning operations by the cleaning member 16 to assure clearing of the outer surface 14*b* of the inner shutter 14.

Third Embodiment

Figure 18:
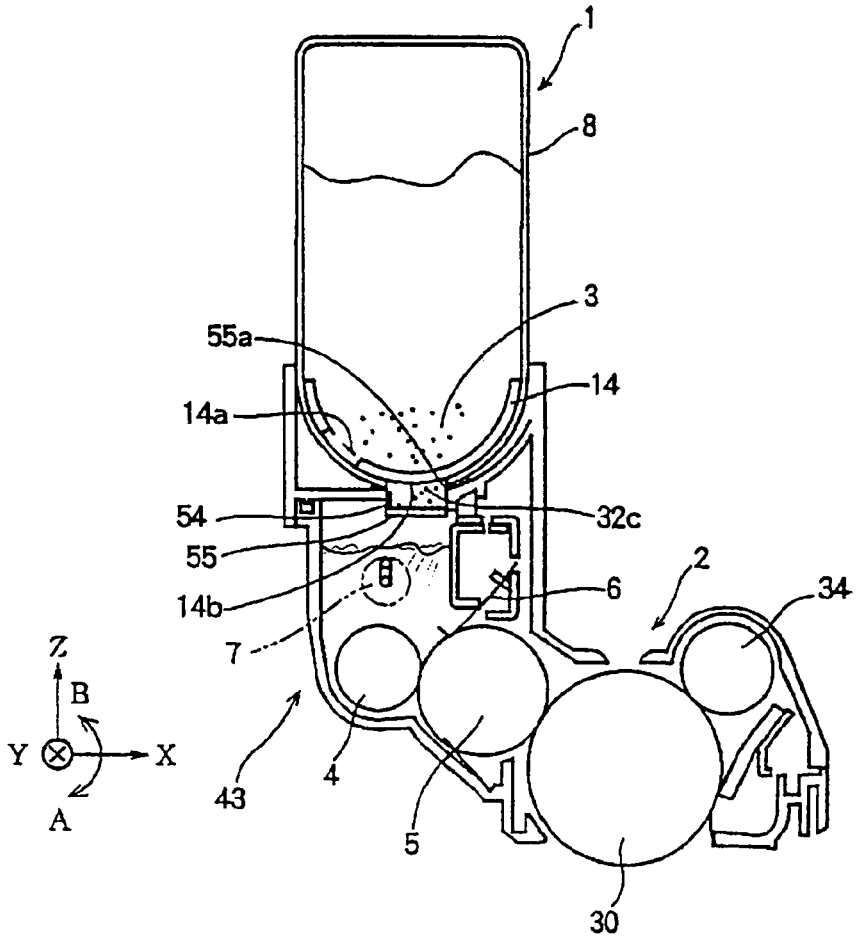
FIG. 18 is a side view of an image forming unit according to the third embodiment of the invention.

In FIG. 18, the image forming unit of this embodiment is different from that of the first embodiment as follows.

Figure 19:
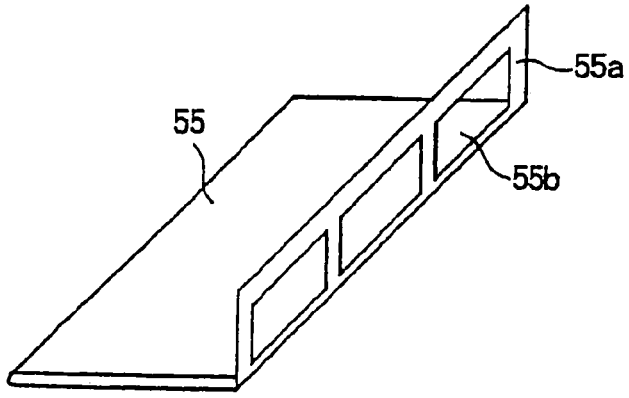
FIG. 19 is a perspective view of an open/close shutter according to the third embodiment.

1) An open/close shutter 55 with a cleaning member 55*a* as shown in FIG. 19 is provided at the toner inlet 32*a* instead of the open/close shutter 22 (FIG. 1) and the cleaning mechanism 9 is omitted.

2) Similarly to the second embodiment, a detection projection 46 is provided on the circumferential surface of the rotary member 15 (FIG. 15) and a detection switch 47 is provided on the inside of a frame wall 32*d* of the process cartridge 2 to detect the contact with the detection projection 46.

Figure 20A:
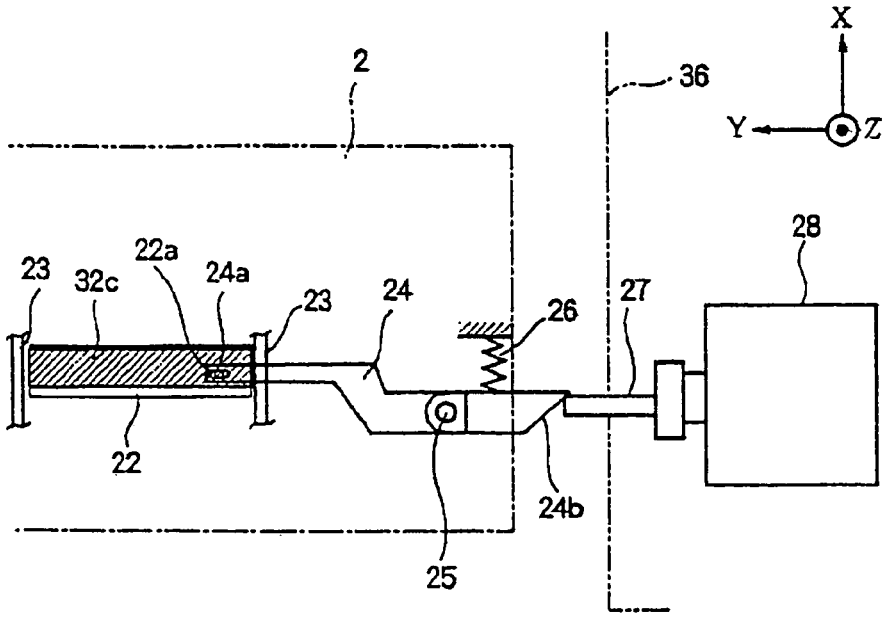
FIGS. 20(*a*) and 20(*b*) are plan views of the open/close mechanism.
Figure 20B:
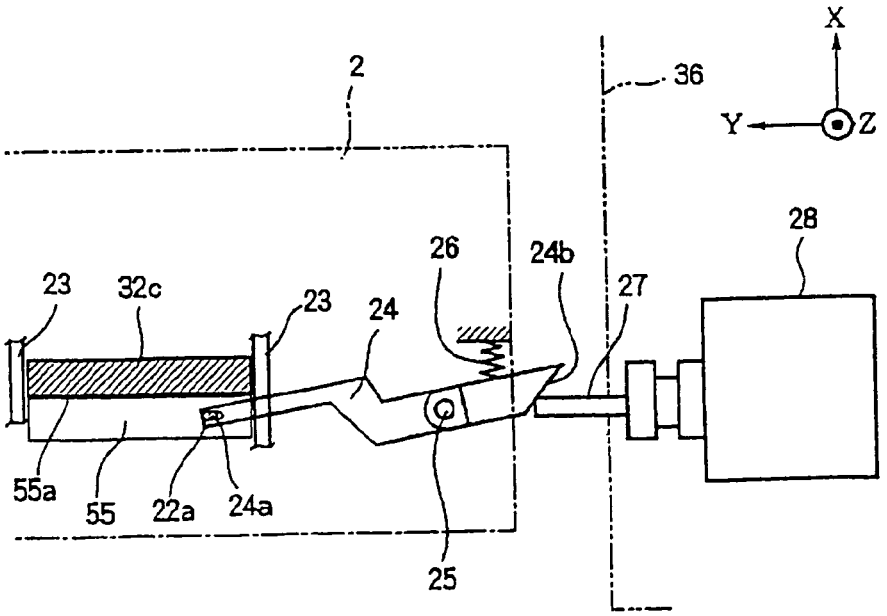

The open/close shutter 55 is at the shut-off position where the toner inlet 32*c* is closed when the solenoid 28 is off as shown in FIG. 20(*a*) and at the open position where the toner inlet 32*c* is open when the solenoid 28 is on as shown in FIG. 20(*b*).

When the open/close shutter 55 is opened/closed, the upper surface of the open/close shutter 55 is loaded with the toner 3 so that the cleaning member 55*a* is provided with openings 55*b* to allow escape of the toner 3, thereby reducing the load.

Figure 21:
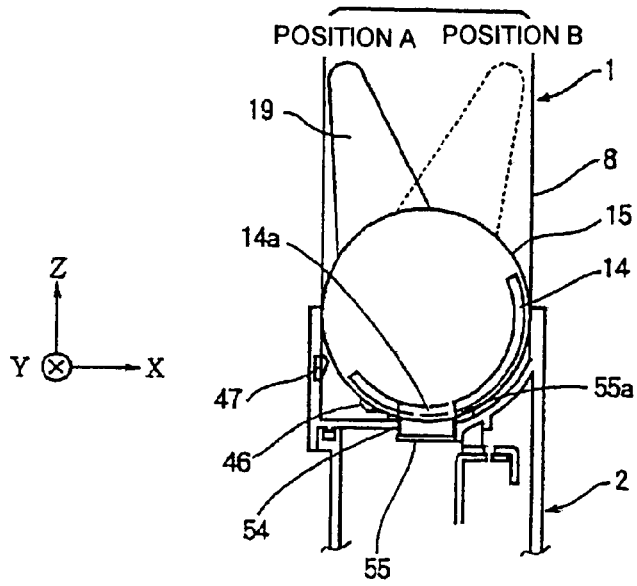
FIG. 21 is a side view of the toner cartridge at the toner supply position.
Figure 22:
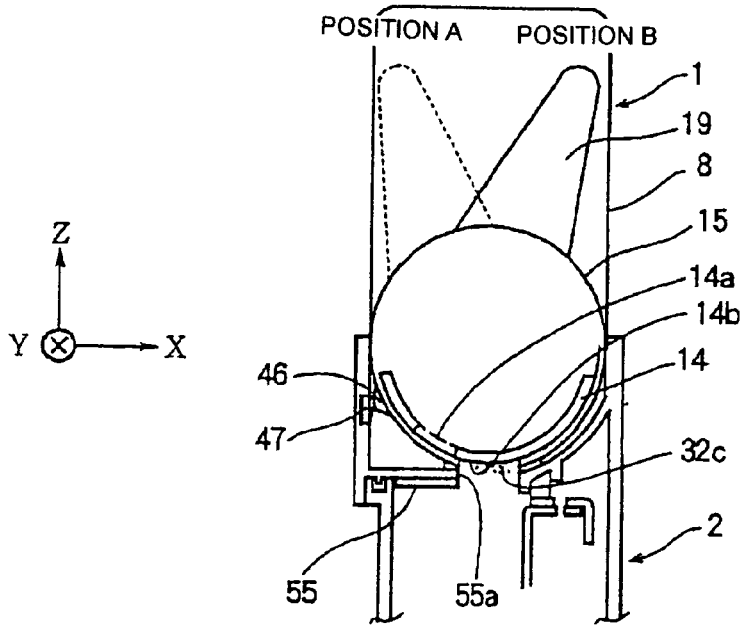
FIG. 22 is a side view of the toner cartridge at the toner shut-off position.

The open/close shutter 55 also cleans the outer surface 14*b* of the inner shutter 14 as shown in FIGS. 21 and 22. When the operation lever 19 is moved from the toner supply state at the position A to the toner shut-off state at the position B, the detection switch 47 is turned on. In response to it, the control section 51 energizes the solenoid 28 for a predetermined period. In sync with the on/off control of the solenoid 28, the cleaning member 55*a* makes a round trip to scrape the toner from the outer surface 14*a* of the inner shutter 14. The cleaning member 54 for dropping the toner into the process cartridge 2 is pressed against the upper surface of the open/close shutter 55 with an appropriate pressure.

Alternatively, the solenoid 28 may be turned on/off for a few times so that the open/close shutter 55 makes round trips for a few times.

As described above, according to the third embodiment, the open/close shutter 55 has not only an open/close function of the toner inlet 32*c* but also a cleaning function of the outer surface 14*b* of the inner shutter 14, thus simplifying the unit and reducing the manufacturing cost and the number of breakdowns.

Fourth Embodiment

Figure 23:
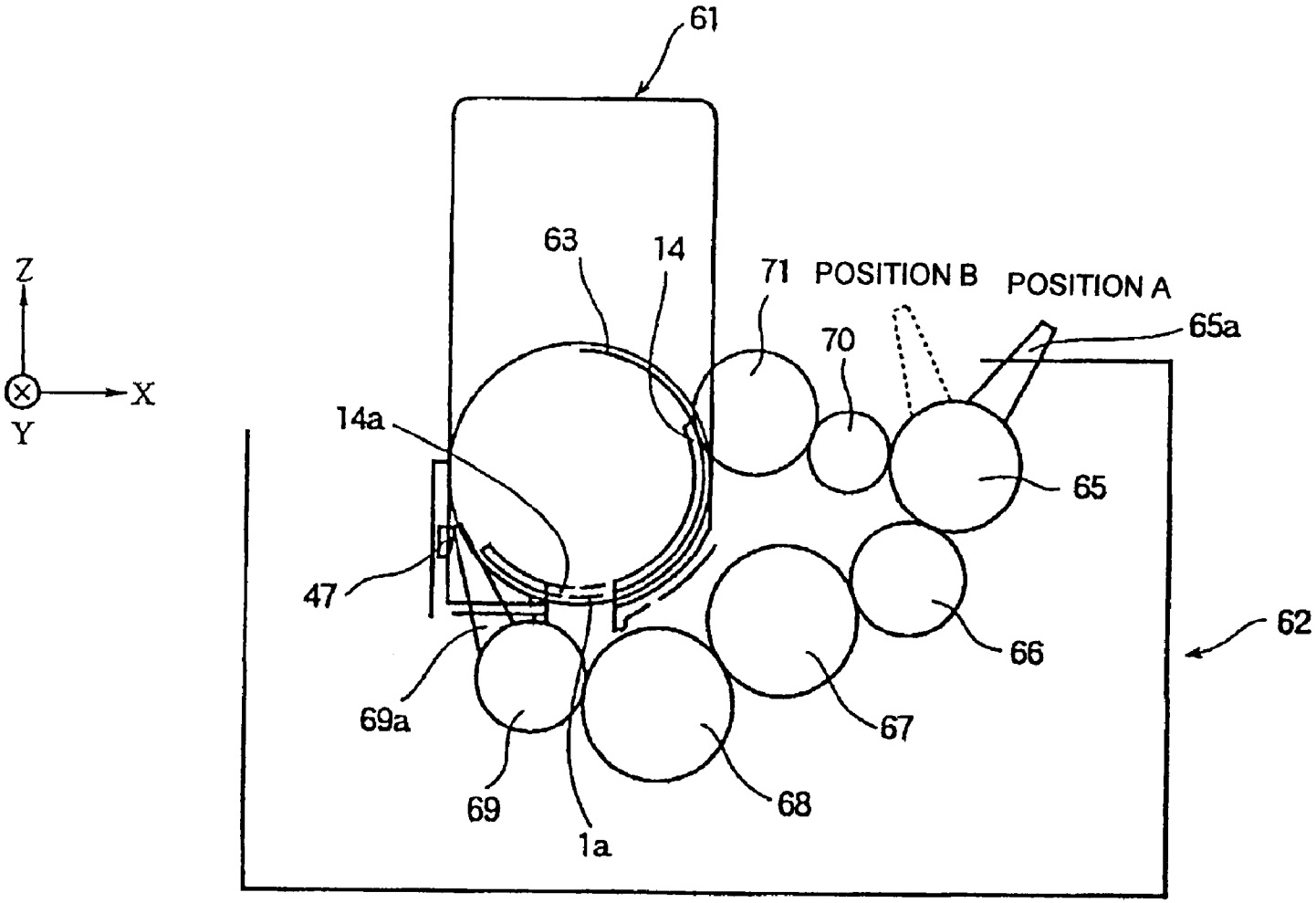
FIG. 23 is a side view of a toner cartridge and a process cartridge according to the fourth embodiment of the invention.

In FIG. 23, a toner cartridge 61 and a process cartridge 62 are different from the toner cartridge 1 and the process cartridge 2 of the second embodiment in that both the operation lever 19 (FIG. 15) and the pressure member upon the detection switch 47 are provided on the process cartridge. The toner cartridge 61 has a passive gear 63 provided integrally with the inner shutter 14 and on the outside of the toner case. When installed in the process cartridge 62, the passive gear 63 engages with the linkage gear 71 provided on the process cartridge 62 to rotate the inner shutter 14.

The process cartridge 62 has a driving gear 65 equipped with an operation lever 65*a*, intermediate gears 66, 67, 68, and 70 for transmitting the rotation of the driving gear 65, and an action lever 69*a* for pressing the detection switch 47. Also, it has an action gear 69 rotated by the rotation force transmitted by the intermediate gears 66, 67, and 68 and the linkage gear 71 rotated by the rotation force transmitted by the intermediate gear 70 and engages with the passive gear 63 of the toner cartridge 61.

When the operation lever 65*a* of the driving gear 65 is at the position A, the toner cartridge 61 is in the toner supply state where the toner opening 1*a* overlaps the variable opening 14*a* of the inner shutter 14, and the operation lever 69*a* is merely in contact with the detection switch 47 so that the detection switch 47 is off. When the operation lever 65*a* is turned to the position B, bringing the toner cartridge 61 into the toner shut-off state where the toner opening 1*a* is closed by the inner shutter 14, and the detection switch 47 is pressed by the operation lever 69*a* into the on state. In response to the detection signal from the detection switch 47 the control system of FIG. 11 performs the same cleaning operation as those of the second embodiment and, therefore, its description will be omitted.

As has been described above, according to the fourth embodiment, both the toner cartridge operation and the toner cartridge state detection are made on the process cartridge 62 so that not only the freedom for unit design is increased but also the process cartridge 62 is always compatible with the toner cartridge 61 to provide a stable cleaning operation. The developer or toner cartridge enables detection of the shut-off state where no developer is discharged so that the mating unit can clean the open/close mechanism during the shut-off state. The area where the developer adheres to the cartridge is cleaned so that the developer cartridge can be removed without dirtying the unit or operator. When the opening of the developer cartridge is closed, the developer adhere area is cleaned automatically so that it is possible to keep the unit and the operator always clean.

What is claimed is:

1. A developer cartridge, comprising:

a container for containing a developer;

an opening for supplying said developer from said container;

an open/close mechanism for opening/closing said opening; and a notification member for notifying a cleaning member disposed outside the container for cleaning the open/close mechanism from outside of an open/close state of said open/close mechanism.

2. The developer cartridge according to claim 1, wherein said open/close mechanism comprises:

an inner shutter rotatable within said developer cartridge and having an inner shutter opening at least a part of which overlaps said opening; and an operation section linked to said inner shutter to rotate said inner shutter.

3. The developer cartridge according to claim 2, wherein said operation section comprises:

an operation lever operatable by an operator; and a rotary member for transmitting an operation of said operation lever to said inner shutter.

4. The developer cartridge according to claim 3, wherein said notification member is provided on said rotary member and movable in sync with rotation of said rotary member.

5. The developer cartridge according to claim 4, wherein said notification member includes an engaging projection provided on said rotary member.

6. The developer cartridge according to claim 1, wherein said notification member notifies said cleaning member that said open/close mechanism is moving from an open state to a closed state.

7. The developer cartridge according to claim 1, wherein said notification member notifies the cleaning member of the open/close state of the open/close mechanism so that the cleaning member moves when the open/close mechanism moves.

8. An image forming unit in which a developer cartridge with an open/close mechanism for opening/closing an opening for supplying a developer is installed, comprising:

a cleaning member provided so as to be contactable with an outside portion of said open/close mechanism; and a moving mechanism for moving said cleaning member in contact with said outside portion.

9. The image forming unit according to claim 8, wherein said moving mechanism operates in sync with a state of said open/close mechanism of said developer cartridge.

10. The image forming unit according to claim 9, wherein said moving mechanism includes an engaging portion for engagement with said open/close mechanism of said developer cartridge.

11. The image forming unit according to claim 10, wherein said moving mechanism comprises:

a movable plate for supporting said cleaning member and guided so as to slide along said outside portion; and a link member rotatable on a body of said image forming unit and having one end for engagement with said movable plate to move it by rotation.

12. The image forming unit according to claim 11, wherein said link member has the other end engaged with said open/close mechanism for rotation in sync with operation of said open/close mechanism.

13. The image forming unit according to claim 11, wherein said link member has the other end for receiving a driving force for rotation.

14. An image forming apparatus from which a developer cartridge having an open/close mechanism for opening/closing an opening for supplying a developer is detachable, comprising:

a cleaning member contactable with an outside portion of said open/close mechanism;

a moving mechanism for moving said cleaning member in contact with said outside portion;

a detector for detecting an open/close state of said open/close mechanism; and an operation section in response to a detection result of said detector to operate said moving mechanism.

15. The image forming apparatus according to claim 14, wherein said detector comprises an engaging section for engaging with said open/close mechanism for detecting its operation and transmitting said operation to said moving mechanism, thereby operating said moving mechanism to operate said cleaning member.

16. The image forming apparatus according to claim 14, which further comprises:

a driving section for driving said moving mechanism; and a control section in response to a detection result of said detector to operate said driving section and said cleaning member.

17. The image forming apparatus according to claim 16, wherein said moving mechanism comprises:

a movable plate for supporting said cleaning member and guided so as to slide along said outside portion; and a rotatable link member having one end engaging with said movable plate to move it by rotation, said driving section engaging with the other end of said link member to operate said movable plate.

18. The image forming apparatus according to claim 17, wherein said driving section includes a solenoid.

19. The image forming apparatus according to claim 16, which further comprises:

a compartment for holding a developer from said developer cartridge; and a developer amount detector for detecting an amount of the developer within said compartment;

said control section being in response to a detection result of said developer amount detector to operate said driving section.

20. The image forming apparatus according to claim 16, which further comprises an operation section provided on a body of said image forming unit for operating said open/close mechanism, said detector detecting operation of said operation section.

21. The image forming apparatus according to claim 20, wherein said control section responds to a detection result of said detector to operate said cleaning member.

* * * * *